US009920987B2

(12) United States Patent
Brostow et al.

(10) Patent No.: US 9,920,987 B2
(45) Date of Patent: Mar. 20, 2018

(54) MIXING COLUMN FOR SINGLE MIXED REFRIGERANT (SMR) PROCESS

(71) Applicant: AIR PRODUCTS AND CHEMICALS, INC., Allentown, PA (US)

(72) Inventors: Adam Adrian Brostow, Emmaus, PA (US); Gowri Krishnamurthy, Sellersville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 257 days.

(21) Appl. No.: 14/707,773

(22) Filed: May 8, 2015

(65) Prior Publication Data

US 2016/0327335 A1 Nov. 10, 2016

(51) Int. Cl.
*F25J 1/00* (2006.01)
*F25J 1/02* (2006.01)

(52) U.S. Cl.
CPC ..... *F25J 1/0291* (2013.01); *F25J 1/004* (2013.01); *F25J 1/0022* (2013.01); *F25J 1/0052* (2013.01); *F25J 1/0055* (2013.01); *F25J 1/0212* (2013.01); *F25J 1/0264* (2013.01); *F25J 1/0267* (2013.01); *F25J 1/0279* (2013.01); *F25J 2210/06* (2013.01); *F25J 2220/62* (2013.01)

(58) Field of Classification Search
CPC ..... F25J 1/004; F25J 1/0022; F25J 1/0042; F25J 1/0055; F25J 1/0057; F25J 1/0219; F25J 1/023; F25J 1/0238; F25J 1/0262
See application file for complete search history.

(56) References Cited

U.S. PATENT DOCUMENTS

| | | | | |
|---|---|---|---|---|
| 4,022,030 | A | 5/1977 | Brugerolle et al. | |
| 5,490,391 | A * | 2/1996 | Hogg | F25J 3/04193 62/646 |
| 5,865,041 | A | 2/1999 | Agrawal et al. | |
| 6,334,334 | B1 * | 1/2002 | Stockmann | C09K 5/04 62/612 |
| 6,347,531 | B1 | 2/2002 | Roberts et al. | |
| 2011/0192193 | A1 * | 8/2011 | Bot | F25J 3/04303 62/643 |
| 2014/0260415 | A1 * | 9/2014 | Ducote, Jr. | F25J 1/0022 62/498 |

FOREIGN PATENT DOCUMENTS

AU 2005202956 A1 2/2006

* cited by examiner

*Primary Examiner* — Frantz Jules
*Assistant Examiner* — Webeshet Mengesha
(74) *Attorney, Agent, or Firm* — Eric J. Schaal

(57) ABSTRACT

A system and method of gas liquefaction having a compression sequence for a mixed refrigerant in which a mixing column is used to provide liquid and vapor product streams at least one step of the compression sequence in which a phase separation is desirable. In addition, the compression sequence may optionally or alternatively use a stripper column in at least one step in the compression sequence in which a phase separation is desirable.

10 Claims, 10 Drawing Sheets

MIXING COLUMN FOR SINGLE MIXED REFRIGERANT (SMR) PROCESS

BACKGROUND

Liquefaction of gases typically employs cryogenic processes comprised of refrigeration cycles generated by expanding at least one refrigerant. A variety of refrigerants might be employed, for example, a mixed refrigerant (MR) stream having a mixture of nitrogen, methane, ethane/ethylene, propane, butanes and pentanes is a commonly used refrigerant in many base-load liquefied natural gas (LNG) plants. The refrigeration cycles employed for liquefaction might be a single mixed refrigerant cycle (SMR), propane-precooled mixed refrigerant cycle (C3MR), dual mixed refrigerant cycle (DMR), mixed refrigerant-expander hybrid cycles such as AP-X™, nitrogen or methane expander cycles, cascade cycle or any other appropriate refrigeration process. The composition of the MR stream is typically optimized for the feed gas composition and operating conditions.

In SMR systems, the SMR is typically compressed in at least two stages of compression and cooled back to close-to-ambient temperature. Some liquid is typically formed at the outlet of at least one intercooler of the SMR system since the mixture contains heavy components to provide refrigeration in the pre-cooling stage. However, such intermediate pressure liquid being formed during compression can lead to irreversible mixing of streams of different temperature, pressure, and/or composition, which can reduce the efficiency of the liquefication operation. Current attempts to eliminate this problem introduce additional cost, complexities and equipment, possibly reducing reliability of the system.

Therefore, there is a need for an improved gas liquefaction process that reduces or eliminates the intermediate pressure liquid being formed while maintaining high efficiency and reliability of the process while also maintaining a low equipment count.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide, as described below and as defined by the claims which follow, comprise improvements to liquefaction processes which use a MR. The disclosed embodiments satisfy the need in the art by using a mixing column in an SMR cycle to eliminate the additional circuit in the main cryogenic heat exchanger while achieving higher liquefaction efficiency obtained due to the low temperature of the liquid stream from the column. It should be understood that, although the embodiments described herein disclose SMR cycles, the principles of the invention are applicable to any MR liquefaction cycle.

In addition, several specific aspects of the systems and methods of the present invention are outlined below.

Aspect 1. A method comprising:

(a) cooling a hydrocarbon fluid in a main heat exchanger against a mixed refrigerant, the cooling of the hydrocarbon feed gas producing a product stream;

(b) withdrawing a low pressure mixed refrigerant stream from the main heat exchanger;

(c) compressing the low pressure mixed refrigerant stream in at least two compression stages in at least one compressor to produce a medium pressure mixed refrigerant stream and high pressure vapor mixed refrigerant stream;

(d) cooling the medium pressure mixed refrigerant stream to produce a medium pressure two phase mixed refrigerant stream;

(e) cooling the high pressure vapor mixed refrigerant stream to produce a high pressure two phase mixed refrigerant stream;

(f) separating the high pressure two phase mixed refrigerant stream into a high pressure liquid mixed refrigerant stream and a high pressure vapor mixed refrigerant stream;

(g) introducing at least a portion of the medium pressure two phase mixed refrigerant stream and the high pressure liquid mixed refrigerant stream into a mixing column;

(h) withdrawing a medium pressure liquid mixed refrigerant stream from a bottom end of the mixing column and a medium pressure vapor mixed refrigerant stream from a top end of the mixing column; and (i) supplying at least a portion of the medium pressure liquid mixed refrigerant stream and at least a portion of the high pressure vapor mixed refrigerant stream to the main heat exchanger.

Aspect 2. The method of Aspect 1, further comprising:

(j) after withdrawing the medium pressure vapor mixed refrigerant stream from the mixing column, compressing the medium pressure vapor mixed refrigerant stream to form a portion of the high pressure vapor mixed refrigerant stream.

Aspect 3. The method of any of Aspects 1 or 2, wherein step (a) comprises liquefying a hydrocarbon feed gas and a mixed refrigerant flowing through a coil wound tube side of a main heat exchanger by indirect heat exchange with the mixed refrigerant flowing through a shell side of the main heat exchanger, the cooling of the hydrocarbon feed gas producing a product stream.

Aspect 4. The method of any of Aspects 1-3, wherein step (c) comprises withdrawing at least one cooled refrigerant stream from the coil wound tube side of the main heat exchanger at a top end of at least one of a plurality of tube bundles, reducing a pressure of the at least one cooled refrigerant stream, then supplying the reduced pressure at least one cooled refrigerant stream to the shell side of the main heat exchanger to irrigate at least one the plurality of tube bundles.

Aspect 5. The method of Aspects 1-4, wherein step (b) comprises withdrawing a shell side mixed refrigerant stream from a shell side of the main heat exchanger at a warm end of the main heat exchanger.

Aspect 6. The method of any of Aspects 3-5, further comprising:

(k) withdrawing at least one cooled mixed refrigerant stream from the coil wound tube side of the main heat exchanger, reducing a pressure of the at least one cooled mixed refrigerant stream, then supplying the reduced pressure at least one cooled mixed refrigerant to the shell side of the main heat exchanger.

Aspect 7. The method of any of Aspects 1-6, further comprising:

(l) expanding the high pressure liquid mixed refrigerant stream before performing step (g).

Aspect 8. The method of any of Aspects 1-7, wherein step (g) comprises separating the medium pressure two phase mixed refrigerant stream into a medium pressure vapor mixed refrigerant stream and a medium pressure liquid mixed refrigerant stream, introducing the medium pressure liquid mixed refrigerant stream and the high pressure liquid mixed refrigerant stream into the mixing column.

Aspect 9. The method of any of Aspects 1-8, further comprising:

(m) separating the product stream into a cold vapor stream and a liquid product stream;

(n) supplying the cold vapor stream and a portion of the medium pressure liquid refrigerant stream to an auxiliary heat exchanger; and (o) cooling the medium pressure liquid refrigerant stream against the cold vapor stream.

Aspect 10. The method of Aspect 9, further comprising:

(p) after performing step (o), supplying the cooled medium pressure liquid refrigerant stream to the shell side of the main heat exchanger.

Aspect 11. An apparatus comprising:

a main heat exchanger having a feed conduit connected to a supply of a hydrocarbon fluid and located at a first end of the main heat exchanger, a product conduit located at a second end of the main heat exchanger that is opposite the first end, a fluid conduit in fluid flow communication with the feed conduit and the product conduit, at least one refrigerant conduit containing a mixed refrigerant, the main heat exchanger being operationally configured to provide an indirect heat exchange between the mixed refrigerant and the feed gas; and a compression system operationally configured to compress and cool the mixed refrigerant and return it to the main heat exchanger, the compression system comprising a plurality of compression stages including first and second compression stages, an intercooler, an aftercooler, and at least one mixing column, the mixing column having a plurality of equilibrium stages, a first mixing column inlet conduit and a second mixing column inlet conduit, a vapor mixing column outlet conduit, and a liquid mixing column outlet conduit.

Aspect 12. The apparatus of Aspect 11, further comprising:

a low pressure conduit in fluid flow communication with the main heat exchanger and an input side of the first compression stage, a first high pressure conduit in fluid flow communication with the aftercooler and an output side of the second compression stage, a first medium pressure conduit in fluid flow communication with the intercooler and the first compression stage, a second high pressure conduit located downstream from the aftercooler and in fluid flow communication with the aftercooler and a first phase separator, a high pressure vapor conduit in fluid flow communication with an upper end of the first phase separator and the main heat exchanger; and wherein the second mixing column inlet conduit comprises a first high pressure liquid conduit in fluid flow communication with a lower end of the first phase separator and the mixing column, the liquid mixing column outlet conduit comprises a medium pressure liquid mixed refrigerant conduit in fluid flow communication with a bottom end of the mixing column and the main heat exchanger, and the vapor mixing column outlet conduit comprises a medium pressure vapor mixed refrigerant conduit in fluid flow communication with a top end of the mixing column.

Aspect 13. The apparatus of any of Aspects 11 or 12, wherein the main heat exchanger comprises a shell defining a shell space and at least one tube bundle located within the shell and having a plurality of sets of coil wound tubes, wherein the plurality of sets of coil wound tubes include the feed conduit and the at least one refrigerant conduit.

Aspect 14. The apparatus of Aspect 13, wherein each of the at least one refrigerant conduit comprises a warm end and a cold end, the cold end of each of the at least one refrigerant conduit being in fluid flow communication with the shell space.

Aspect 15. The apparatus of Aspect 14, wherein the warm end of a first refrigerant conduit of the at least one refrigerant conduit is in fluid flow communication with the high pressure vapor conduit and the warm end of a second refrigerant conduit of the at least one refrigerant conduit is in fluid flow communication with the medium pressure liquid mixed refrigerant conduit.

Aspect 16. The apparatus of any of Aspects 11-15, wherein the first mixing column input conduit comprises a second medium pressure conduit located downstream from the intercooler and in fluid flow communication with the intercooler and the mixing column.

Aspect 17. The apparatus of any of Aspects 11-16, wherein the medium pressure vapor mixed refrigerant conduit is in fluid flow communication with a top end of the mixing column and an input side of one of the plurality of compression stages.

Aspect 18. The apparatus of any of Aspects 11-17, further comprising a medium pressure two phase conduit downstream from the intercooler and in fluid flow communication with a second phase separator, the second phase separator having medium pressure vapor conduit and a medium pressure liquid conduit, wherein the first mixing column inlet conduit comprises that medium pressure liquid conduit comprise and the medium pressure vapor conduit is in fluid flow communication with an input side of one of the plurality of compression stages.

Aspect 19. The apparatus of Aspect 18, wherein the vapor mixing column outlet conduit is in fluid flow communication with at least one selected from the group of: the second phase separator and the medium pressure two phase conduit.

Aspect 20. The apparatus of any of Aspects 11-19, further comprising:

a third phase separator located downstream from and in fluid flow communication with the product conduit, the third phase separator having a cold vapor product conduit and a liquid product conduit; and an auxiliary heat exchanger in fluid flow communication with the cold vapor product conduit, the auxiliary heat exchanger being operationally configured to provide indirect heat exchange between the cold vapor product conduit and at least one auxiliary conduit, each of the at least one auxiliary conduit containing the mixed refrigerant or the hydrocarbon fluid.

Aspect 21. A method comprising:

(a) cooling a hydrocarbon fluid in a main heat exchanger against a mixed refrigerant, the cooling of the hydrocarbon feed gas producing a product stream;

(b) withdrawing a low pressure mixed refrigerant stream from the main heat exchanger;

(c) performing a compression sequence on the low pressure mixed refrigerant stream, the compression sequence comprising:

(i) compressing the mixed refrigerant in at least two compression stages in at least one compressor to produce a medium pressure mixed refrigerant stream and high pressure mixed refrigerant stream;

(ii) cooling the medium pressure mixed refrigerant stream;

(iii) cooling the high pressure mixed refrigerant stream; and (iv) after performing the cooling steps, introducing at least one of the high pressure mixed refrigerant stream and the medium pressure mixed refrigerant stream into a stripper column; and (d) returning at least a portion of the mixed refrigerant to the main heat exchanger after performing the compression sequence.

Aspect 22. The method of claim 21, wherein the compression sequence further comprises:

(v) withdrawing mixed refrigerant in liquid phase from a bottom end of the stripper column;

(vi) reboiling and reintroducing into the stripper column a first portion of the mixed refrigerant withdrawn in step (v); and (vii) withdrawing mixed refrigerant in vapor phase from a top end of the stripper column.

Aspect 23. The method of Aspect 22, wherein step (iv) comprises, after performing the cooling step, introducing the high pressure mixed refrigerant stream into the stripper column at a first temperature.

Aspect 24. The method of Aspect 23, wherein the compression sequence further comprises:

(viii) cooling a second portion of the mixed refrigerant withdrawn in step (v) to about the first temperature; and (ix) throttling the cooled second portion of the mixed refrigerant withdrawn in step (v), then introducing the second portion of the mixed refrigerant into one of a separator or mixing column.

Aspect 25. The method of Aspect 24, wherein step (ix) comprising throttling the cooled second portion of the mixed refrigerant withdrawn in step (v), then introducing the second portion of the mixed refrigerant into a mixing column.

Aspect 26. The method of any of Aspects 3-10, further comprising:

(j) combining the high pressure vapor mixed refrigerant stream from the separator and the medium pressure liquid mixed refrigerant stream from the mixing column and introducing the combined stream into the coil wound tube side of the main heat exchanger.

BRIEF DESCRIPTION OF THE DRAWING FIGURES

DETAILED DESCRIPTION OF THE PREFERRED EMBODIMENT(S)

Figure 1A:
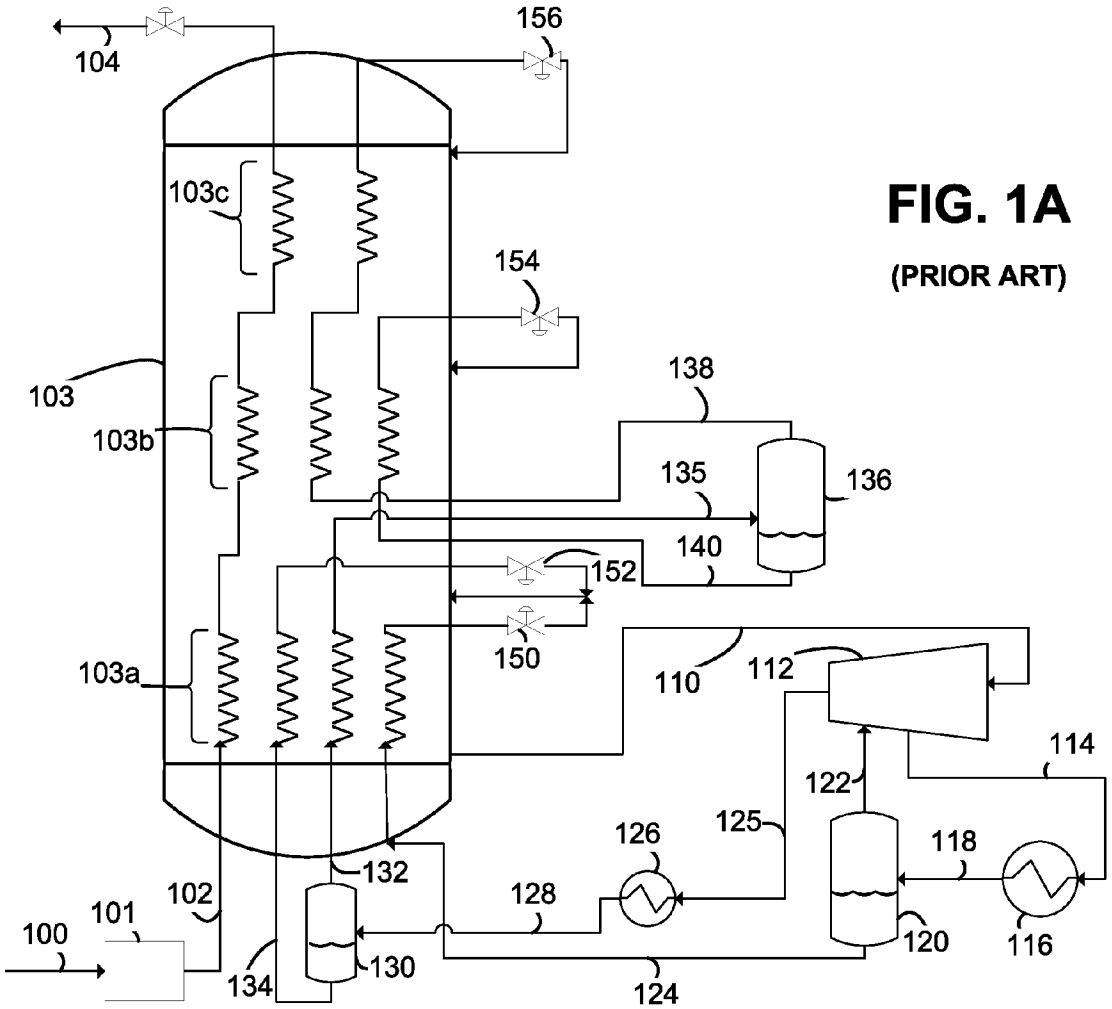
FIG. 1A (PRIOR ART)
FIG. 1A is a schematic flow diagram of an SMR cycle in accordance with the prior art.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. It being understood that various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features. Similarly, elements that are similar to those of other embodiments are represented by reference numerals differentiated by factors of 100. For example, the compressor 112 in FIG. 1A corresponds to the compressor 212 in FIG. 2. Such elements should be regarded as having the same function and structure unless otherwise stated or depicted herein, and the discussion of such elements may therefore not be repeated for subsequent embodiments.

The term "fluid flow communication," as used in the specification and claims, refers to the nature of connectivity between two or more components that enables liquids, vapors, and/or gases to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrogen fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The term "heavy mixed refrigerant", as used in the specification and claims, means an MR in which hydrocarbons at least as heavy as ethane comprise at least 80% if the overall composition of the MR. Preferably, hydrocarbons at least as heavy as butane comprise at least 10% of the overall composition of the mixed refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

As used in the specification and claims, the terms "high", "medium", and "low" are intended to express relative values for a property of the elements with which the these terms are used. For example, a high pressure stream is intended to indicate a stream having a higher pressure than any medium pressure stream or low pressure stream described or claimed in this application. Similarly, a medium pressure stream is intended to indicate a stream having a higher pressure than any low pressure stream described in the specification or claims, but lower than any high pressure stream described or claimed in this application.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquid oxygen (LOX), liquid argon (LAR), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

Table 1 defines a list of acronyms employed throughout the specification and drawings as an aid to understanding the described embodiments:

TABLE 1

| | | | |
|---|---|---|---|
| SMR | Single Mixed Refrigerant Cycle | MCHE | Main Cryogenic Heat Exchanger |
| DMR | Dual Mixed Refrigerant Cycle | MR | Mixed Refrigerant |
| C3MR | Propane-precooled Mixed Refrigerant Cycle | MRL | Mixed Refrigerant Liquid |
| LNG | Liquid Natural Gas | MRV | Mixed Refrigerant Vapor |

Described embodiments provide an efficient process for the liquefaction of a feed gas stream and is particularly applicable to the liquefaction of natural gas. Referring to FIG. 1A, a typical SMR process of the prior art is shown. A gas feed stream 100, which is preferably natural gas, is cleaned and dried by known methods in a pretreatment section 101 to remove water, acid gases such as $CO_2$ and $H_2S$ and other contaminants such as mercury, resulting in a pretreated feed stream 102. The pretreated feed stream 102, which is now essentially water free, is cooled in an MCHE 103 in three steps: a pre-cooling step, a liquefaction step, and a sub-cooling step. Each step occurs at a cooling zone or tube bundle within the MCHE 103: pre-cooling, to a temperature below 10 degrees Celsius, preferably below about 0 degrees Celsius, and more preferably below about −20 degrees Celsius, occurs at a first bundle 103*a*, liquefaction, to a temperature between about −150 degrees Celsius and about −70 degrees Celsius, preferably between about −145 degrees Celsius and about −100 degrees Celsius, occurs at a second bundle 103*b*, and sub-cooling to a temperature between about −170 degrees Celsius and about −120 degrees Celsius, preferably between about −170 degrees Celsius and about −140 degrees Celsius, occurs at a third bundle 103*c*.

The term "essentially water free" means that any residual water in the pretreated feed stream 102 is present at a sufficiently low concentration to prevent operational problems due to water freeze out in the downstream cooling and liquefaction process. In the embodiments described in this application, this means a water concentration that is preferably not more than 1.0 ppm and, more preferably between 0.1 ppm and 0.5 ppm. In the MCHE 103, at least a portion of, and preferably all of, the refrigeration is provided by vaporizing at least a portion of sub-cooled refrigerant streams after pressure reduction across reducing valves.

A low pressure gaseous MR stream 110 is withdrawn from the bottom of the shell side of the MCHE 103 and is then compressed in a compressor 112. The low pressure gaseous MR stream 110 is typically withdrawn at a temperature at or near ambient temperature and at a pressure of less than 10 bar. The resulting medium pressure stream 114 is cooled in a medium pressure aftercooler 116 to produce a medium pressure two phase stream 118. The medium pressure two phase stream 118 is separated in a medium pressure phase separator 120 to produce a medium pressure liquid stream 124 and a medium pressure vapor stream 122. The medium pressure vapor stream 122 is further compressed in the compressor 112, or a separate compressor (not shown). The resulting high pressure vapor stream 125 is cooled in a high pressure aftercooler 126 to produce a high pressure two phase stream 128. The high pressure two phase stream 128 is separated in a high pressure phase separator 130 into a high pressure liquid stream 134 and a high pressure vapor stream 132. The process of compressing and cooling the MR after it is withdrawn from the bottom of the MCHE 103, then returned to the tube side of the MCHE 103 as multiple streams, is generally referred to herein as a compression sequence.

Both the medium pressure liquid stream 124 and high pressure liquid stream 134 are cooled, in two separate circuits, in the first bundle 103*a* of the MCHE 103. The medium pressure liquid stream 124 and high pressure liquid stream 134 are reduced in pressure across a medium pressure reducing valve 150 and a high pressure liquid reducing valve 152 respectively, and introduced to the MCHE 103 to provide refrigeration in the pre-cooling step.

The high pressure vapor stream 132 is cooled and partially liquefied in the first bundle 103*a* of the MCHE 103, resulting in a cold two phase stream 135. The cold two phase stream 135 is separated in a cold high pressure phase separator 136 into a cold high pressure liquid stream 140 and a cold high pressure vapor stream 138. Liquid streams leaving phase separators are referred to in the industry as MRL and vapor streams leaving phase separators are referred to in the industry as MRV, even after they are subsequently liquefied.

The cold high pressure liquid stream 140 is cooled in the second bundle 103*b* of MCHE 103, reduced in pressure across the cold high pressure liquid reducing valve 154, and introduced to the MCHE 103 to provide refrigeration in the liquefaction step. The cold high pressure vapor stream 138 is cooled and liquefied in the second 103*b* and third 103*c* bundles of the MCHE 103, reduced in pressure across the cold high pressure vapor reducing valve 156, and introduced to the MCHE 103 to provide refrigeration in the sub-cooling step. The addition circuit in the MCHE 103 is particularly desirable in applications in which a heavy mixed refrigerant is used.

There are other ways of processing the medium pressure liquid stream 124. For example, the MR composition might be adjusted to eliminate the medium pressure liquid stream 124, the medium pressure phase separator 120, and an additional circuit in the MCHE 103, at the cost of process efficiency. Another option is that the high pressure liquid stream 134 could be reduced in pressure and mixed with the medium pressure liquid stream 124 to enter the MCHE 103 as one stream with some vapor content, again eliminating an additional circuit in MCHE 103. Alternatively, an eductor or ejector could be used to obtain a stream at an intermediate pressure. The high pressure liquid stream 134 could be reduced in pressure and mixed with the medium pressure two phase stream 118 entering the medium pressure phase separator 120. This will also eliminate an additional circuit in the MCHE 103 and produce colder liquid and vapor streams leaving the medium pressure phase separator 120, resulting in some overall efficiency benefit, but is negated by irreversible mixing loss since there is inefficiency associated with mixing streams of a different pressure, temperature, or composition. A hydraulic turbine could be used to reversibly reduce the pressure of the high pressure liquid stream 134. The medium pressure liquid stream 124 could be pumped and combined with the high pressure vapor stream 132, eliminating an additional circuit in the MCHE 103 but at the cost of introducing a rotating piece of equipment and potentially lowering reliability of the system.

Figure 1B:
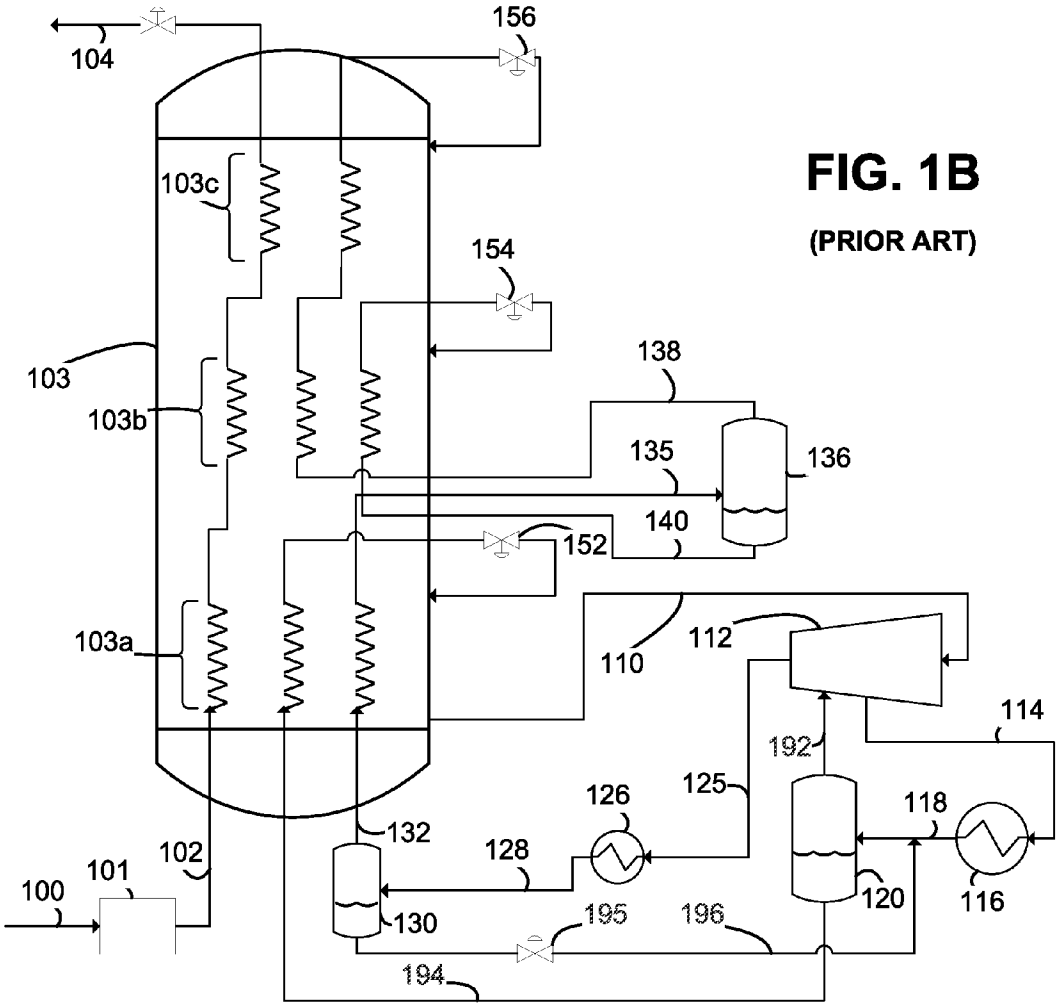
FIG. 1B (PRIOR ART)
FIG. 1B is a schematic flow diagram of another SMR cycle in accordance with the prior art.

FIG. 1B shows another embodiment of a prior art SMR process. In the system of FIG. 1B, liquid from the high pressure phase separator 130 (stream 196) is throttled back (e.g., by valve 195) to the interstage pressure. The resulting two phase stream is mixed with the medium pressure two phase stream 118 from the intercooler 216. This mixture is then introduced to the medium pressure phase separator 120. The vapor portion from the medium pressure phase separator 120 (stream 192) is further compressed, and the single resulting liquid stream (stream 194) is cooled in the MCHE 103. Thus, an additional circuit is eliminated from FIG. 1A of the prior art (e.g., the tube bundle coupled to valve 150 of FIG. 1A), and produces colder liquid and vapor streams from the medium pressure phase separator 120. This results in a small efficiency benefit. However, mixing streams of different temperature and composition (e.g., stream 196 after throttling and stream 118) is thermodynamically inefficient.

Figure 2:
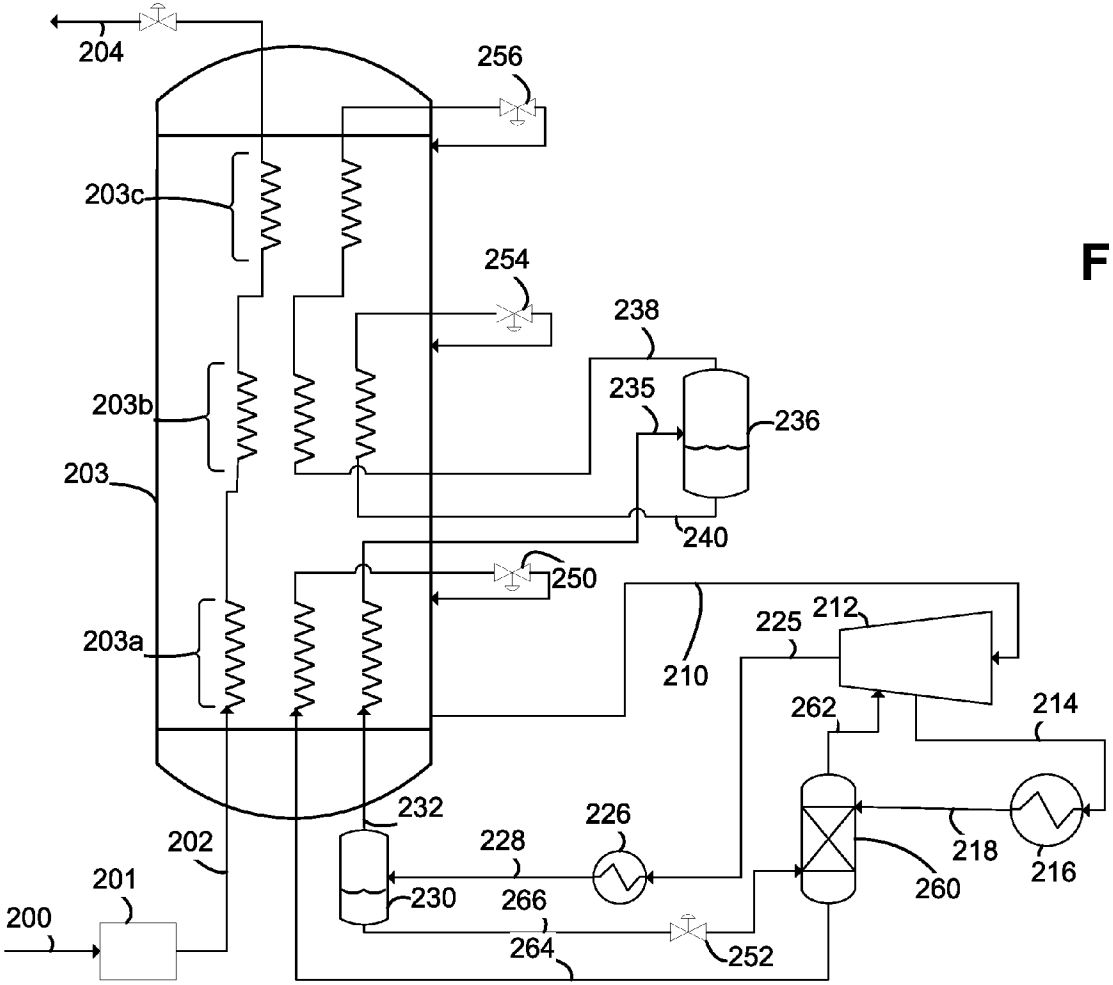
FIG. 2 is a schematic flow diagram of an SMR system in accordance with a first exemplary embodiment.

FIG. 2 shows an exemplary embodiment of the current invention. In FIG. 2, the medium pressure phase separator 120 shown in FIG. 1A is replaced with a mixing column 260. Mixing columns, such as mixing column 260, operate on the same thermodynamic principles as a distillation column (also referred to in the art as a separation or fractionation column). However, the mixing column 260 performs a task opposite to a distillation (fractionation) column—it reversibly mixes fluids in a plurality of equilibrium stages, instead of separating the components of a fluid. In contrast to a distillation column, the top of the mixing column is warmer than the bottom. The structures used in a mixing column to achieve mixing are similar to structures used in a distillation column, such as packing or trays. U.S. Pat. No. 4,022,030, incorporated herein by reference as if fully set forth, describes structure and operating principles for a mixing column in a different application from that of the present invention. It is beneficial to have multiple stages in the mixing column but partial benefit can be achieved by a single tray column.

A medium pressure two phase stream 218 enters the top of the mixing column 260. The medium pressure vapor stream 262 is at a close-to-ambient temperature when it leaves the top of the mixing column 260. A medium pressure liquid stream 264 leaving the bottom of the mixing column 260 is colder than ambient temperature. In this embodiment, the temperature of medium pressure liquid stream 264 leaving the bottom of the mixing column 260 is preferably 5-15 degrees Celsius colder than ambient temperature plus an approach temperature and, more preferably about 10 degrees Celsius colder than ambient temperature plus the approach temperature. Depending on the ambient temperature and type of heat exchanger used, the approach temperature can be between 3 and 20 degrees C. For example, if the ambient temperature is 30 degrees Celsius and the approach temperature is 5 degrees Celsius, the temperature of medium pressure liquid stream 264 leaving the bottom of the mixing column 260 is preferably 20-30 degrees Celsius and, more preferably, about 25 degrees Celsius.

The medium pressure vapor stream 262 is further compressed in the compressor 212, or a different compressor (not shown). The resulting high pressure vapor stream 225 is cooled in a high pressure aftercooler 226 to produce a high pressure two phase stream 228. The high pressure two phase stream 228 is separated in a high pressure phase separator 230 into a high pressure liquid stream 266 and a high pressure vapor stream 232. The high pressure liquid stream 266 is reduced in pressure across a high pressure liquid reducing valve 252 and introduced to the bottom of the mixing column 260. The medium pressure liquid stream 264 is cooled in the first bundle 203*a* of the MCHE 203, reduced in pressure across a medium pressure liquid reducing valve 250, and introduced to the MCHE 203 to provide refrigeration in the pre-cooling step.

Advantages of this embodiment over the prior art include the elimination of the additional circuit (e.g., the high pressure liquid stream 134 of FIG. 1A) in the MCHE 203, even when a heavy mixed refrigerant is used. High liquefaction efficiency obtained due to the relatively low temperature of the medium pressure liquid stream 264 from the mixing column 260.

Figure 2B:
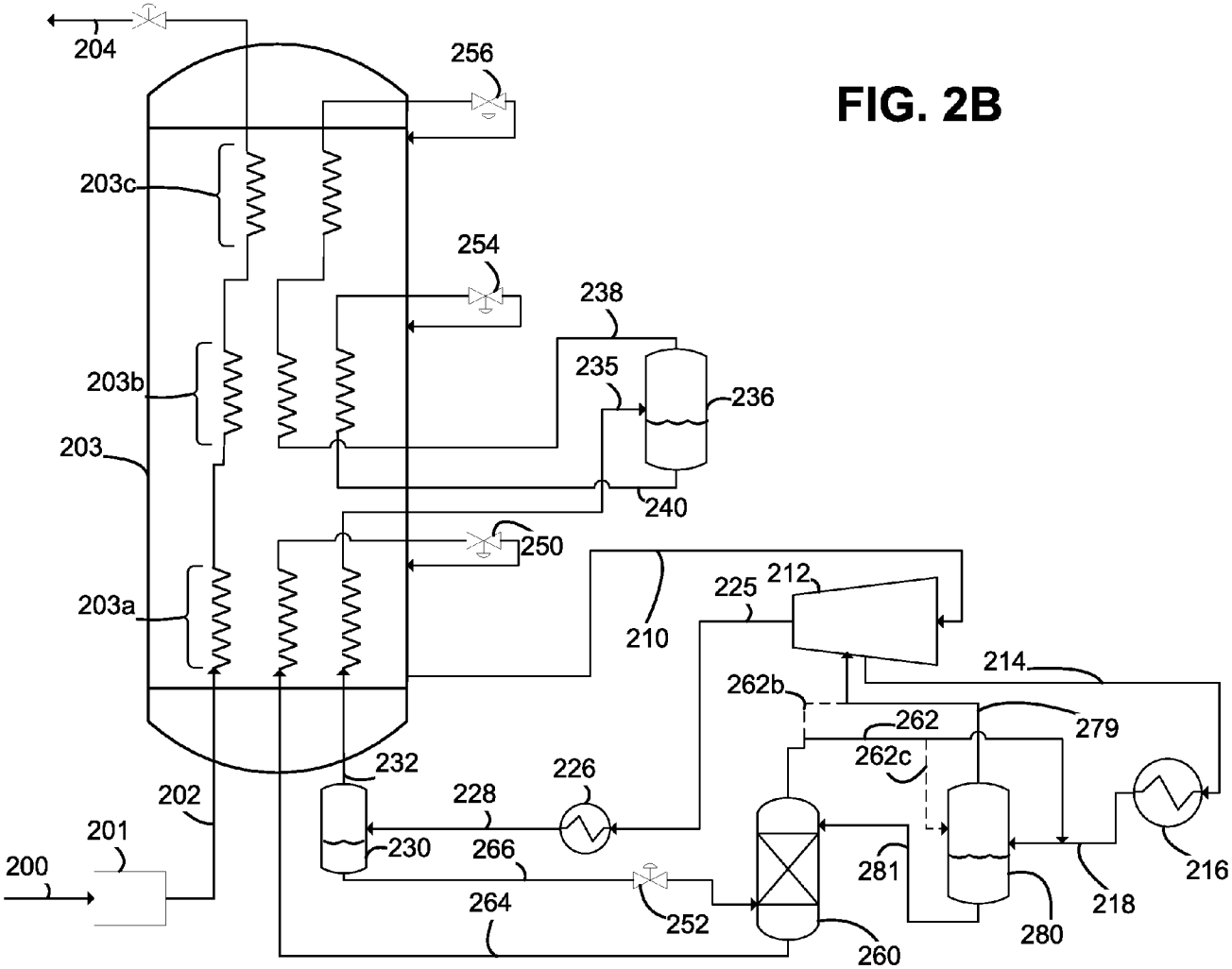
FIG. 2B is a schematic flow diagram of an SMR system in accordance with an optional configuration for the first exemplary embodiment.

FIG. 2B shows an optional variation of the first embodiment, in which the medium pressure two phase stream 218 is directed to a medium pressure phase separator 280, where it is separated into a medium pressure vapor stream 279 and a medium pressure liquid stream 281. The medium pressure vapor stream 279 is returned to the compressor 212 or a different compressor (not shown). The medium pressure liquid stream 281 from the medium pressure phase separator 280 is fed into the mixing column 260. The medium pressure vapor stream 262 from the mixing column 260 is mixed with medium pressure two phase stream 218 from the intercooler 216 or fed directly into the medium pressure phase separator 280 (as shown by stream 262*c*). Alternatively, the medium pressure vapor stream 262*b* from the mixing column 260 could be mixed with the medium pressure vapor stream 279 from the medium pressure phase separator 280 and returned to the compressor 212 or a different compressor (not shown).

This variation of the first embodiment would enable a top portion of the mixing column 260 to be smaller, than the variation shown in FIG. 2 due to a reduction in vapor load on the mixing column.

Figure 3:
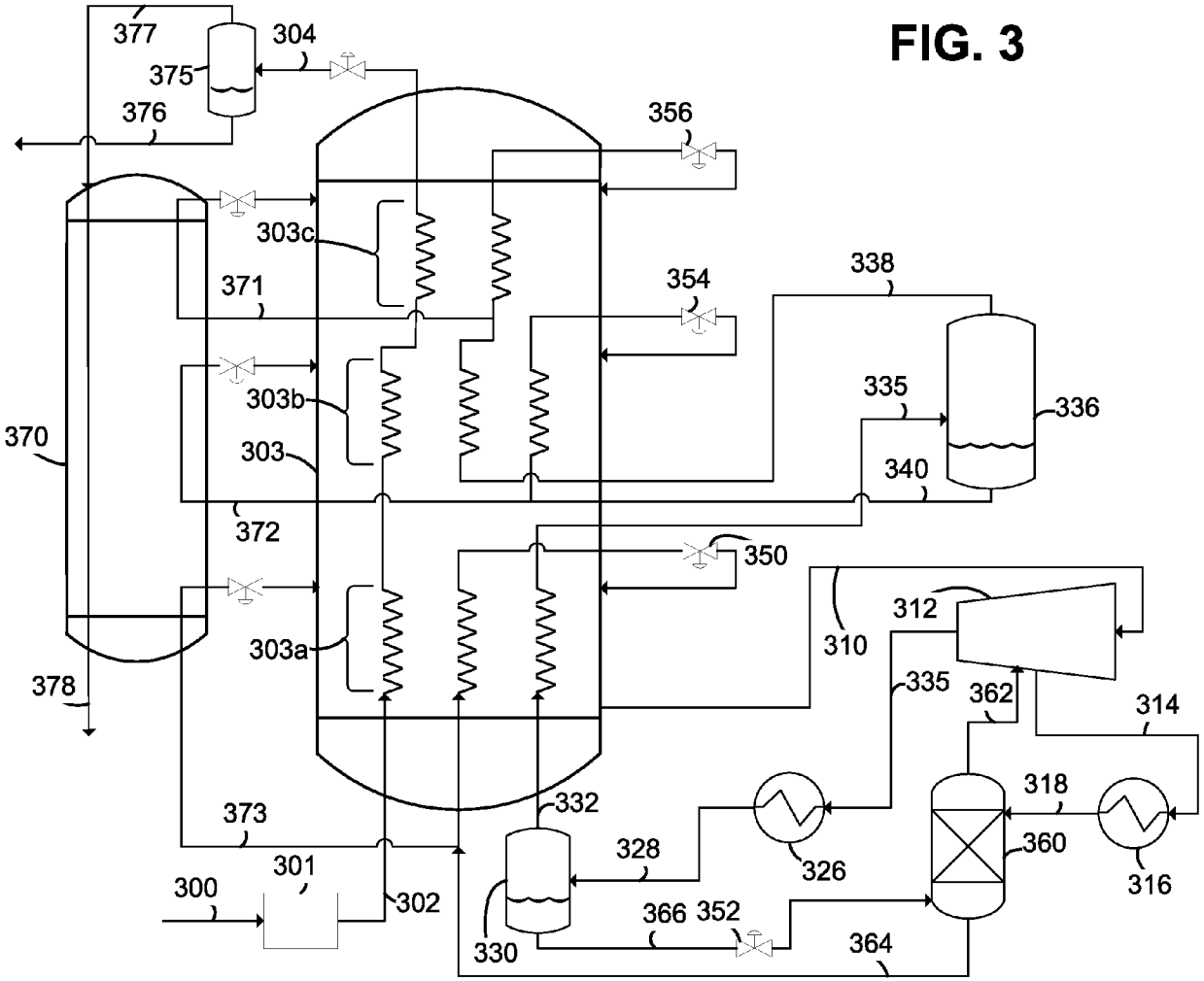
FIG. 3 is a schematic flow diagram of an SMR system in accordance with a second exemplary embodiment.

FIG. 3 shows an embodiment having an auxiliary flash heat exchanger 370 that is used to cool MR streams from the MCHE 303 against a cold vapor stream 377 that has been separated from the liquid product stream 376. The product stream 304 is introduced into a product phase separator 375 or a storage tank (not shown) to produce the cold vapor stream 377, comprised of cold end flash gas or boil off gas, and a liquid product stream 376. In order to improve the efficiency of the auxiliary flash heat exchanger 370, the cold vapor stream 377 is first warmed against a first auxiliary stream 371, which is a portion of the cold high pressure vapor stream 338 entering the third bundle 303*c* of the MCHE 303. The first auxiliary stream 371 is cooled and recombined with the main portion of the cold high pressure vapor stream 338 at the top of the third bundle 303*c* on the shell side of the MCHE 303. The cold vapor stream 377 is next warmed against a second auxiliary stream 372, which is a portion of the cold high pressure liquid stream 340 entering the second bundle 303*b* of the MCHE 303. Alternatively, the second auxiliary stream 372 could comprise a portion of the cold high pressure vapor stream 338.

The second auxiliary stream 372 is cooled and recombined with the main portion of the cold high pressure liquid stream 340 at the top of the second bundle 303*b* on the shell side of the MCHE 303. Finally, the cold vapor stream 377 is warmed against a third auxiliary stream 373, which is a portion of the medium pressure liquid stream 364, the liquid stream from the mixing column 360. Alternative, the auxiliary stream 373 could comprise a portion of the medium pressure vapor stream 332. The third auxiliary stream 373 is cooled and recombined with the main portion of a medium pressure liquid stream 364 at the top of the first bundle 303*a* on the shell side of the MCHE 303. A vapor stream 378, the warmed by flash gas from the auxiliary flash heat exchanger 370, may optionally be compressed and sent to the fuel header or compressed and recycled to feed (gas feed stream 300) or sent to flare (not shown). The embodiments shown in FIGS. 3, 4 and 5 could be implemented either with or without a mixing column and for any liquefaction cycle because the auxiliary flash heat exchange features described in these embodiments result in improved process efficiency both with or without the use of a mixing column.

Figure 4:
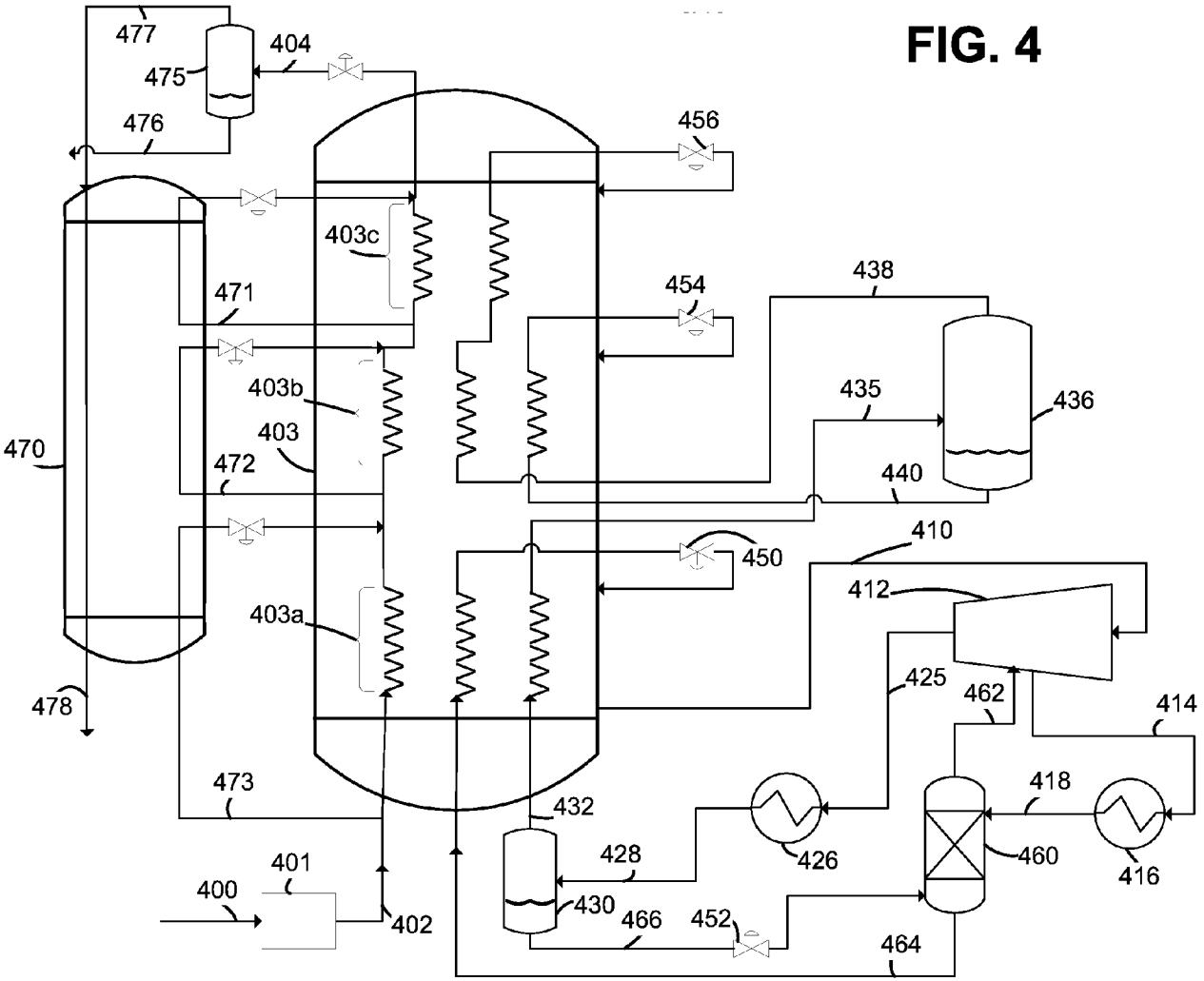
FIG. 4 is a schematic flow diagram of an SMR system in accordance with a third exemplary embodiment.

FIG. 4 shows an embodiment in which the cold vapor stream 477 is warmed via the auxiliary flash heat exchanger 470 against a first auxiliary stream 471, a portion of the feed stream at the inlet of the third bundle 503*c* of the MCHE 403. In this embodiment, the cooled feed stream is combined with the product stream 404 from the MCHE 403. The cold vapor stream 477 then warmed against a second auxiliary stream 472, a portion of the feed stream at the inlet of the second bundle 403*b*, which is returned to the product (top) of the second bundle 403*b* of the MCHE 403. The cold vapor stream 477 is warmed against third auxiliary stream 473, a portion of the pretreated feed stream 402 to the first bundle 403*a*, and the cooled feed stream is combined with the feed stream at the outlet of the first bundle 403*a* of the MCHE 403.

Figure 5:
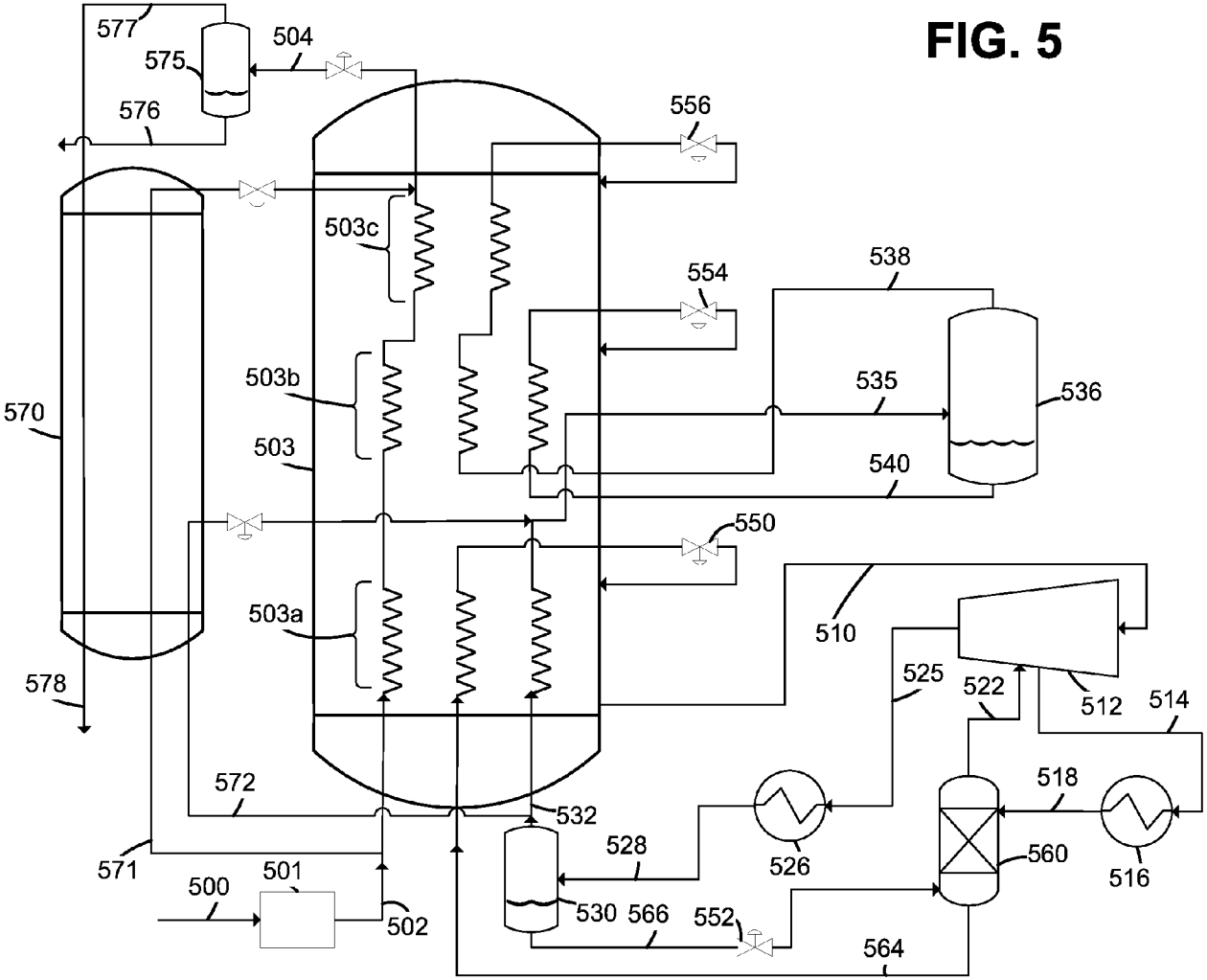
FIG. 5 is a schematic flow diagram of an SMR system in accordance with a fourth exemplary embodiment.

FIG. 5 shows an embodiment in which the cold vapor stream 577 is also warmed via the auxiliary flash heat exchanger 570 against the first auxiliary stream 571, a portion of the pretreated feed stream 502 to the first bundle 503*a*, and the cooled feed stream is combined with the feed stream at the outlet of the third (cold) bundle 503*c* of the MCHE 503. In this embodiment, the cold vapor stream 577 is also warmed against the second auxiliary stream 572, a portion of high pressure vapor stream 532, and the resulting cold stream is combined with the cold two phase stream 534. Any other combination of cooled streams could be used to balance the auxiliary flash heat exchanger 570. Other combinations of the features shown in FIGS. 3-5 relating to the use of an auxiliary flash heat exchanger to warm flash gas are possible. For example, the flash gas could be first warmed against cold MRV, then against cold MRL, and then the feed gas.

Figure 6:
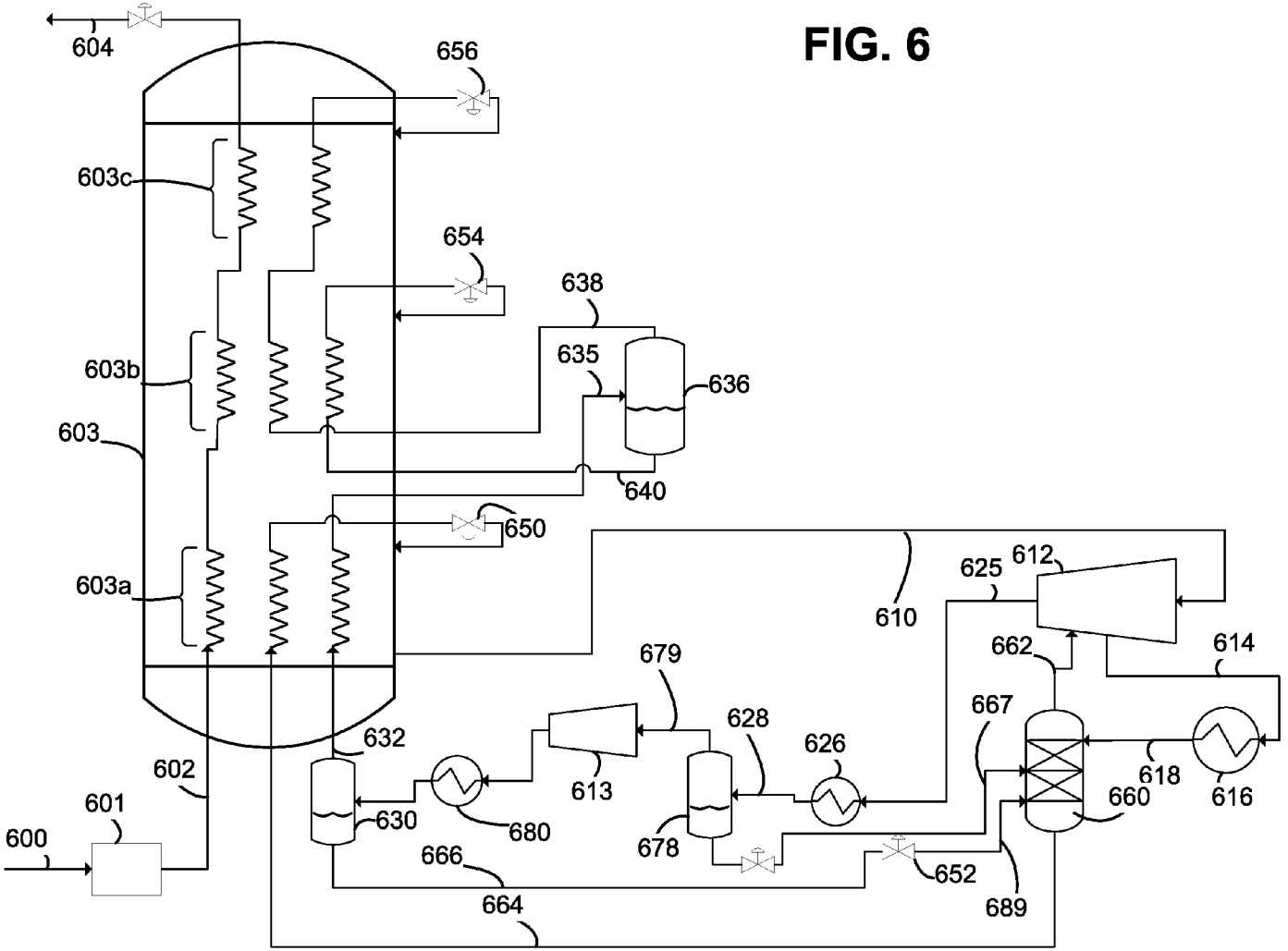
FIG. 6 is a schematic flow diagram of an SMR system in accordance with a fifth exemplary embodiment.

FIG. 6 shows another exemplary embodiment, which is similar to the embodiment of FIG. 2B but includes an addition compression stage (compressor 613) and an additional phase separation (in phase separator 678), which results in three streams 618,689,667 being fed to the mixing column 660, preferably at three different locations. The high pressure two phase stream 628 is separated in the phase separator 678 and the vapor stream 679 exiting the phase separator 678 is further compressed in compressor 613 before being cooled (by an aftercooler 680) and introduced into phase separator 630. Alternatively, a mixing column could be used in place of the phase separator 678, a phase separator could be used in place of the mixing column 660. Other embodiments with additional compression stages are possible. Embodiments with two or more mixing columns are also possible.

Figure 7:
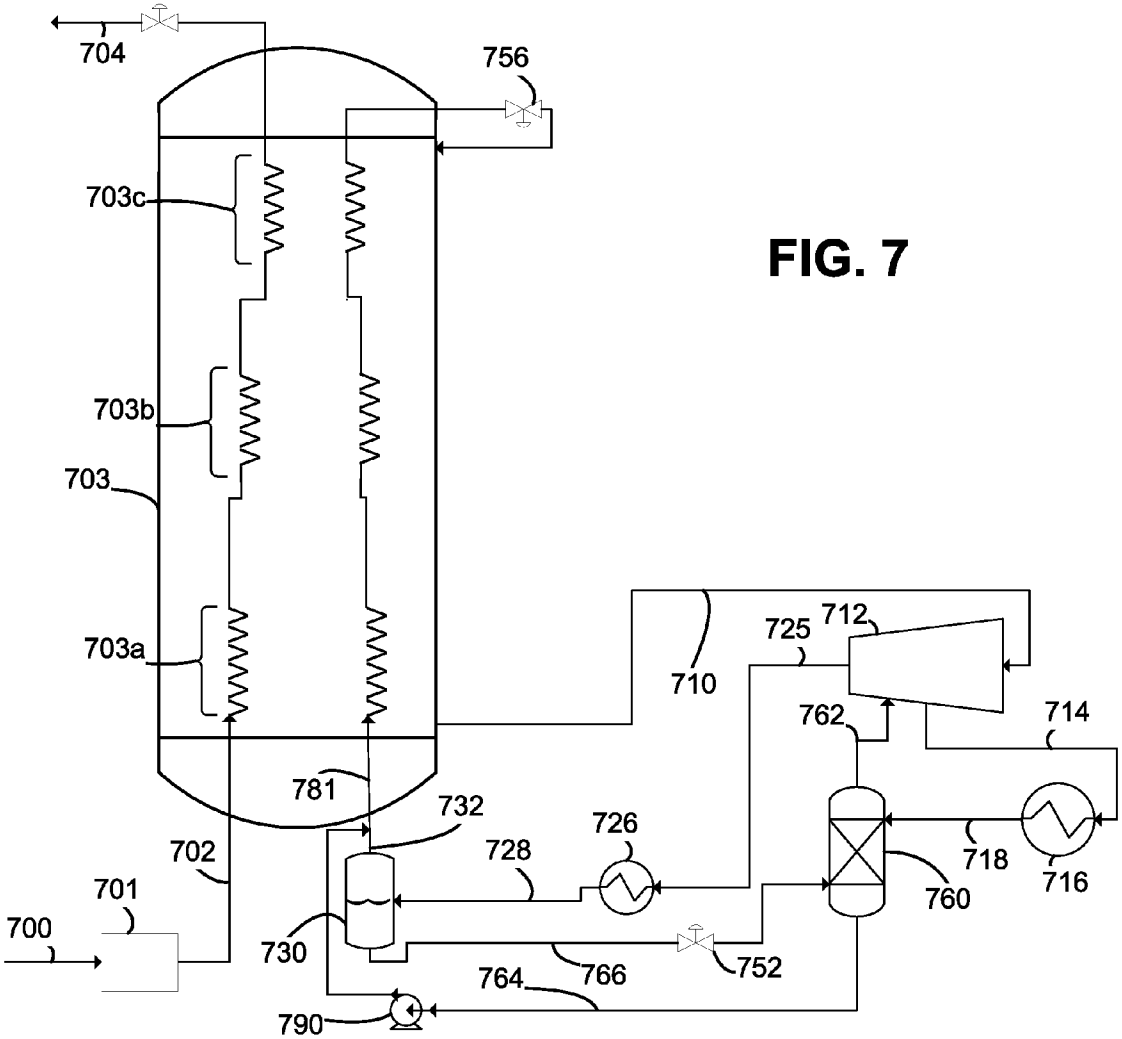
FIG. 7 is a schematic flow diagram of an SMR system in accordance with a sixth exemplary embodiment.

FIG. 7 shows another exemplary embodiment in which the medium pressure liquid stream 764 is preferably pumped (via pump 790) to higher pressure and combined with high pressure vapor stream 732 to produce a two-phase stream 781 that is sent to the MCHE 703. This eliminates another tube circuit in the main exchanger. The combined stream is cooled through the tube bundles 703*a-c* of the MCHE 703 and is sent directly to J-T valve 756. This eliminates the need for a phase separator and additional circuit in both the first and second bundles 703*a*,703*b*, which simplifies the system at the cost of some efficiency. In a further variation, a stripper column could be used in place of the phase separator 730.

Figure 8:
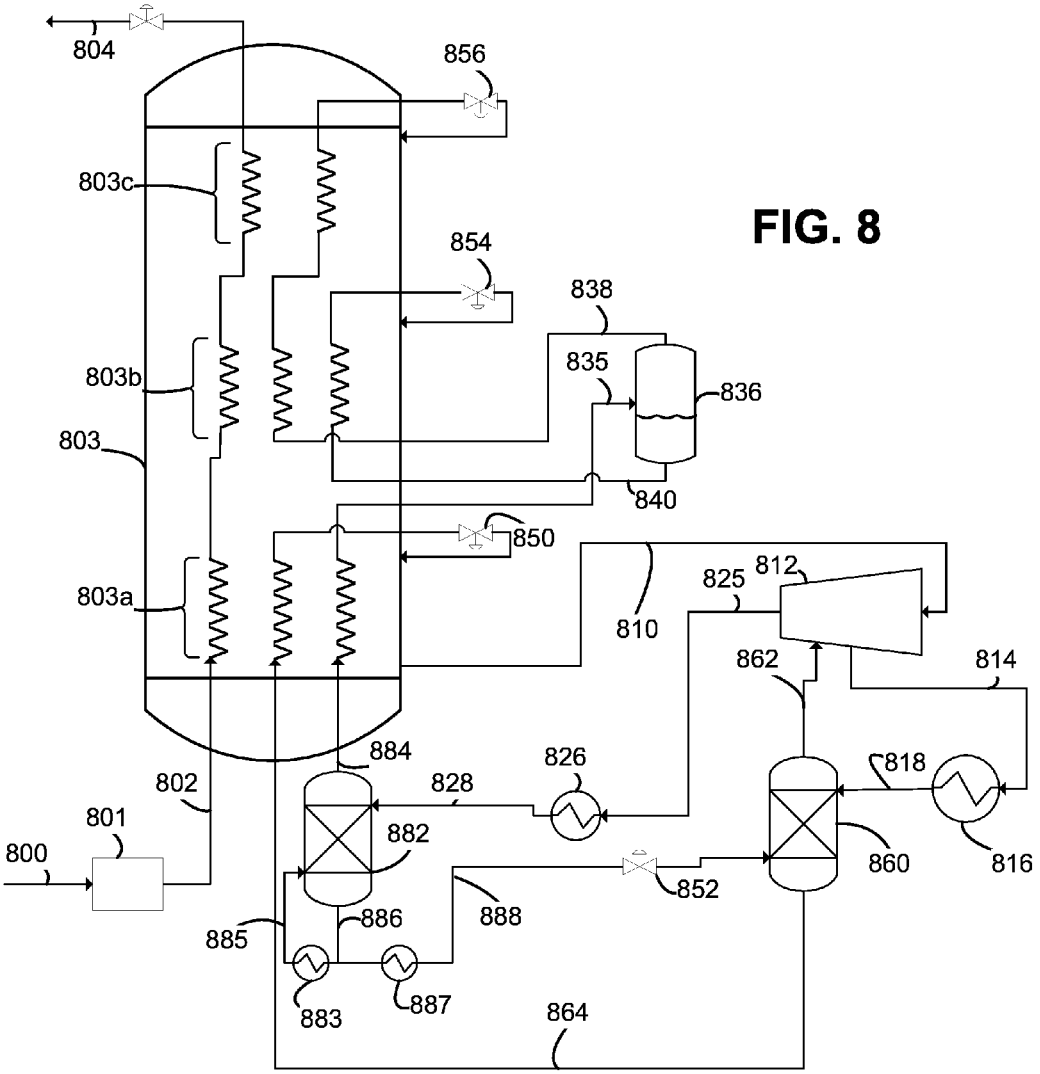
FIG. 8 is a schematic flow diagram of an SMR system in accordance with a seventh exemplary embodiment.

FIG. 8 shows another exemplary embodiment of the invention in which the high-pressure phase separator 230 of FIG. 2B has been replaced with a stripper column 882. As used in the specification and claims, the term "stripper column" should be understood to mean a type of distillation/fractionation column that includes a reboiler heat exchanger 883 but does not include a condenser. The high-pressure two-phase stream 828 is introduced to the top of the stripper column 882 to provide reflux. The overhead vapor product 884 is introduced into the MCHE 803. A portion of the bottoms liquid product stream 886 is fed to the reboiler 883 to provide stripping vapor traffic (stream 885) for the stripper column 882. The rest of the bottoms liquid product 886 is cooled in a cooler 887. The resulting liquid product stream 888 is at (or near) the temperature of stream 828 and is throttled in valve 852 before being fed to the mixing column 830.

Use of the stripper column 882 produces liquid (886) and vapor (884) products at about the same temperature but, unlike a phase separator, the products 886,884 are not in equilibrium with one another. The overhead vapor product 884 becomes enriched in lighter components and/or increases in flow. Conversely, bottoms liquid product 886 becomes become enriched in heavier components and/or decreases in flow. Accordingly, the use of the stripper column 882 improves the liquefaction efficiency of the process over the use of a phase separator.

In further alternate embodiments, some or all mixed refrigerant phase separators could be replaced with stripper columns to improve vapor-liquid separation. In addition, the reboiler 883 could be replaced by a heat exchanger that exchanges heat with any hot stream to provide the reboiling duty necessary for the process. It should be noted that, although the stripper column 882 is shown in this embodiment as being used in combination with the mixing column 860, the stripper column 882 could be used in embodiments in which no mixing column is used. In one such embodiment, the portion of the liquid bottoms product 888 that is not reboiled could be sent to the MCHE 803 via an additional tube circuit.

Other embodiments of the present invention are possible. For example, additional compression stages may be provided, as well as additional phase separators and ambient heat exchangers. Liquid from any phase separator could be sent to the mixing column 860. Embodiments with multiple mixing columns are also possible. Multiple compressor types such as centrifugal, axial, integral gear and others may be employed. Various column designs such as packed and tray type designs may be utilized.

While the described embodiments are especially pertinent to natural gas liquefaction using coil wound heat exchangers, they are not limited to only this application and they are applicable to liquefaction processes using other heat exchangers such as plate and fin heat exchangers, brazed aluminum heat exchangers, etc.

EXAMPLE 1

The following is an example of the operation an exemplary embodiment of the invention. The example process and data are based on simulations of an SMR process similar to embodiment one in FIG. 2 in a plant that produces about two million tons (1.81 million metric tons) per annum of LNG. In order to simplify the description of this example, elements and reference numerals described with respect to the embodiment shown in FIG. 2 will be used.

The product stream 204 has a flow rate of 31558 lb moles per hour (14314 kg moles per hour) of natural gas having the composition shown below in Table 2. The pretreated feed stream 202 enters the MCHE 203 at 116.6 degrees Fahrenheit (47 degrees Celsius) and 870 psia (60 bar) and is cooled to −237 degrees Fahrenheit (−152 degrees Celsius).

TABLE 2

| Feed Gas Composition | |
|---|---|
| Component | Mole Fraction |
| Nitrogen | 0.008 |
| Methane | 0.888 |
| Ethane | 0.067 |
| Propane | 0.025 |
| Heavier HCs | 0.012 |

The low pressure gaseous MR 210 has a flow rate of 74527 lb moles per hour (33805 kg moles per hour), the MR having the composition shown in Table 3, leaves the MCHE 203 at close-to-ambient temperature, for example, 89.6 degrees Fahrenheit (32.0 degrees Celsius), and is compressed from 54 psia (3.7 bar) to 262 psia (18.1 bar) in the compressor 212, and is cooled in the intercooler 216 to 116.6 degrees Fahrenheit.

TABLE 3

| Refrigerant Composition | |
|---|---|
| Component | Mole Fraction |
| Nitrogen | 0.034 |
| Methane | 0.218 |
| Ethylene | 0.322 |
| Propane | 0.241 |
| Iso-pentane | 0.168 |

This interstage liquid, the medium pressure two phase stream 218, is fed to the top of the mixing column 260. The medium pressure vapor stream 262 leaves the top of the mixing column 260 at 116.7 degrees Fahrenheit (47.1 degrees Celsius), is further compressed in the compressor 212 to 635 psia (4.4 bar), cooled by the high pressure aftercooler 226 to 116.6 degrees Fahrenheit (47.0 degrees Celsius), and is separated in the high pressure phase separator 230 into the high pressure vapor stream 232 and the high pressure liquid stream 266. The high pressure vapor stream 232 is cooled in the first bundle 203*a* of the MCHE 203 and eventually reduced in pressure across the cold high pressure liquid reducing valve 254 and cold high pressure vapor reducing valve 256 to provide refrigeration in the second bundle 203*b* and the third bundle 203*c* of the MCHE 203. The high pressure liquid stream 266 is reduced in pressure across high pressure liquid reducing valve 252 and introduced to the bottom of the mixing column 260. The medium pressure liquid stream 264 leaves the bottom of the mixing column 260 at 95 degrees Fahrenheit (35 degrees Celsius), is cooled in the MCHE 203 and eventually reduced in pressure across medium pressure liquid reducing valve 250 to provide refrigeration in the first bundle 203*a* of the MCHE 203.

EXAMPLE 2

This example is a modeled comparison between the performance of the MR compression system of the prior art system shown in FIG. 1B and the MR compression system of the embodiment of the invention shown in FIG. 2. The ambient temperature in this case is 33 degrees C. and the approach temperature is 15 degrees C. More specifically, Table 4 compares stream temperatures and vapor percentages for streams 118, 292, 294 and 296 of the system of FIG. 1B (prior art) with values for streams 218, 262, 264 and 266 of the system of FIG. 2. As shown, the temperature of the medium pressure liquid stream 264 of the system of FIG. 2 is significantly colder than the temperature of the liquid stream 194, which lowers the refrigeration load required for liquefication. Thus, the embodiment of FIG. 2 can be expected to provide a production benefit on the order of 1% over the prior art. Similar improvements in efficiency can be expected from the embodiments shown in FIGS. 3 & 4.

TABLE 4

| Cycle | FIG. 1B | FIG. 2 | FIG. 1B | FIG. 2 | FIG. 1B | FIG. 2 | FIG. 1B | FIG. 2 |
|---|---|---|---|---|---|---|---|---|
| Stream | HP in | HP in | MP in | MP in | V out | V out | L out | L out |
| Stream Ref # in figures | 118 | 218 | 196 | 266 | 192 | 262 | 194 | 264 |
| Temp. (C.) | 47.0 | 47.0 | 25.9 | 27.4 | 42.4 | 47.1 | 42.4 | 35.1 |
| Pressure (bar) | 17.5 | 17.5 | 17.5 | 17.5 | 17.5 | 17.5 | 17.5 | 17.5 |
| Vapor (mole %.) | 83% | 86% | 30% | 30% | 100% | 100% | 0% | 0% |

While the principles of the claimed invention have been described above in connection with exemplary embodiments, it is to be clearly understood that this description is made only by way of example and not as a limitation of the scope of the claimed invention.

What is claimed is:

1. A method comprising:

(a) cooling a hydrocarbon fluid in a main heat exchanger against a mixed refrigerant, the cooling of the hydrocarbon feed gas producing a product stream;

(b) withdrawing a low pressure mixed refrigerant stream from the main heat exchanger;

(c) compressing the low pressure mixed refrigerant stream in at least two compression stages in at least one compressor to produce a medium pressure mixed refrigerant stream and high pressure vapor mixed refrigerant stream;

(d) cooling the medium pressure mixed refrigerant stream to produce a medium pressure two phase mixed refrigerant stream;

(e) cooling the high pressure vapor mixed refrigerant stream to produce a high pressure two phase mixed refrigerant stream;

(f) separating the high pressure two phase mixed refrigerant stream into a high pressure liquid mixed refrigerant stream and a high pressure vapor mixed refrigerant stream;

(g) introducing at least a portion of the medium pressure two phase mixed refrigerant stream into a top end of a mixing column and the high pressure liquid mixed refrigerant stream into a bottom end of the mixing column, wherein the mixing column comprises a plurality of equilibrium stages comprising trays, packing, or a combination thereof;

(h) withdrawing a medium pressure liquid mixed refrigerant stream from a bottom end of the mixing column and a medium pressure vapor mixed refrigerant stream from a top end of the mixing column, wherein the medium pressure liquid mixed refrigerant stream withdrawn from the bottom end of the mixing column is 5-15 degrees Celsius colder than the medium pressure vapor mixed refrigerant stream withdrawn from the top end of the mixing column; and (i) supplying at least a portion of the medium pressure liquid mixed refrigerant stream and at least a portion of the high pressure vapor mixed refrigerant stream to the main heat exchangers;

wherein the mixed refrigerant of step (a) is a fluid comprising at least two hydrocarbons.

2. The method of claim 1, further comprising:

(j) after withdrawing the medium pressure vapor mixed refrigerant stream from the mixing column, compressing the medium pressure vapor mixed refrigerant stream to form a portion of the high pressure vapor mixed refrigerant stream.

3. The method of claim 1, wherein step (a) comprises liquefying a hydrocarbon feed gas and a mixed refrigerant flowing through a coil wound tube side of a main heat exchanger by indirect heat exchange with the mixed refrigerant flowing through a shell side of the main heat exchanger, the cooling of the hydrocarbon feed gas producing a product stream.

4. The method of claim 3, wherein step (c) comprises withdrawing at least one cooled refrigerant stream from the coil wound tube side of the main heat exchanger at a top end of at least one of a plurality of tube bundles, reducing a pressure of the at least one cooled refrigerant stream, then supplying the reduced pressure at least one cooled refrigerant stream to the shell side of the main heat exchanger to irrigate at least one the plurality of tube bundles.

5. The method of claim 3, wherein step (b) comprises withdrawing a shell side mixed refrigerant stream from a shell side of the main heat exchanger at a warm end of the main heat exchanger.

6. The method of claim 3, further comprising:

(k) withdrawing at least one cooled mixed refrigerant stream from the coil wound tube side of the main heat exchanger, reducing a pressure of the at least one cooled mixed refrigerant stream, then supplying the reduced pressure at least one cooled mixed refrigerant to the shell side of the main heat exchanger.

7. The method of claim 1, further comprising:

(l) expanding the high pressure liquid mixed refrigerant stream before performing step (g).

8. The method of claim 1, wherein step (g) comprises separating the medium pressure two phase mixed refrigerant stream into a medium pressure vapor mixed refrigerant stream and a medium pressure liquid mixed refrigerant stream, introducing the medium pressure liquid mixed refrigerant stream and the high pressure liquid mixed refrigerant stream into the mixing column.

9. The method of claim 1, further comprising:

(m) separating the product stream into a cold vapor stream and a liquid product stream;

(n) supplying the cold vapor stream and a portion of the medium pressure liquid refrigerant stream to an auxiliary heat exchanger; and (o) cooling the medium pressure liquid refrigerant stream against the cold vapor stream.

10. The method of claim 9, further comprising:

(p) after performing step (o), supplying the cooled medium pressure liquid refrigerant stream to the shell side of the main heat exchanger.

* * * * *